US007907854B2

(12) United States Patent
Shima

(10) Patent No.: US 7,907,854 B2
(45) **Date of Patent: *Mar. 15, 2011**

(54) IMAGE FORMING APPARATUS AND IMAGE FORMING METHOD

(75) Inventor: Koichi Shima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 689 days.

This patent is subject to a terminal disclaimer.

(21) Appl. No.: 11/640,217

(22) Filed: Dec. 18, 2006

(65) Prior Publication Data

US 2007/0280707 A1 Dec. 6, 2007

(30) Foreign Application Priority Data

Jun. 6, 2006 (JP) ..... 2006-156986

(51) Int. Cl.
*G03G 15/00* (2006.01)

(52) U.S. Cl. ..... 399/26; 399/50; 399/176

(58) Field of Classification Search ..... 361/214, 361/225; 399/26, 48, 50, 168, 174, 176
See application file for complete search history.

(56) References Cited

U.S. PATENT DOCUMENTS

| | | | | |
|---|---|---|---|---|
| 4,346,986 | A * | 8/1982 | Kuge et al. | 399/50 |
| 5,453,819 | A * | 9/1995 | Shimura et al. | 399/174 |
| 5,485,248 | A * | 1/1996 | Yano et al. | 399/73 |
| 5,629,755 | A * | 5/1997 | Ohtsuka | 399/176 |
| 5,678,136 | A * | 10/1997 | Watanabe et al. | 399/100 |
| 7,471,906 | B2 * | 12/2008 | Shima | 399/26 |
| 2005/0111869 | A1 * | 5/2005 | Takami et al. | 399/89 |

FOREIGN PATENT DOCUMENTS

| | | |
|---|---|---|
| JP | A 59-69774 | 4/1984 |
| JP | A 5-223513 | 8/1993 |
| JP | A 9-101654 | 4/1997 |
| JP | A 2001-201922 | 7/2001 |
| JP | A 2002-23464 | 1/2002 |
| JP | A 2002-108068 | 4/2002 |

* cited by examiner

*Primary Examiner* — David P Porta
*Assistant Examiner* — Benjamin Schmitt
(74) *Attorney, Agent, or Firm* — Oliff & Berridge, PLC

(57) ABSTRACT

An image forming apparatus includes a photoconductor, a charging member, a voltage applying unit that applies at least one of voltage of a DC component and voltage of an AC component to the charging member, a capacitance unit connected to a superposition point for the DC component and the AC component, a DC current measuring unit that measures the value of DC current passed from the charging member to the photoconductor, a capacitance measuring unit that measures the electrostatic charge amount of current coming into the capacitance unit, and a control unit that integrates the DC current value measured by the DC current measuring unit with time for which the voltage is applied to the photoconductor and calculates a charge amount corresponding to the thickness of the photosensitive thin film by subtracting the electrostatic charge amount measured by the capacitance measuring unit from the result of integration.

12 Claims, 12 Drawing Sheets

IMAGE FORMING APPARATUS AND IMAGE FORMING METHOD

BACKGROUND (1) Technical Field

The present invention relates to an image forming apparatus having a mechanism that homogeneously charges a photoconductor by applying an AC component and a DC component thereto according to a contact or proximity charging method on a charge-by-discharge basis, and more specifically to a technique of measuring the film thickness of a photoconductor.

(2) Related Art

Various components (such as a charging roller, a development brush, a transfer roller, a cleaning brush, and a cleaning blade) are provided on a surface of a photoconductor provided in an image forming apparatus in physical contact with the surface. A photosensitive layer formed on the surface of the photoconductor has its surface gradually worn by repetitive physical contact with such components for each step of image forming processing. Frictional force by the cleaning brush and the cleaning blade is particularly significant and plays a large part in the wearing away of the photosensitive layer.

When the photosensitive layer has its thickness reduced to a predetermined degree or more by the wear, the photosensitivity may significantly be reduced or the charge characteristic degrades, the surface cannot be charged homogeneously to a predetermined potential, and a clear image can no longer be formed. The thickness of the photosensitive layer of the photoconductor should be measured, and the useful life of the photoconductor should be notified.

SUMMARY

According to an aspect of the invention, there is provided an image forming apparatus including a photoconductor driven to rotate and having a photosensitive thin film formed on its surface, a charging member that charges the photosensitive thin film of the photoconductor, a voltage applying unit that applies at least one of voltage of a DC component and voltage of an AC component to the charging member, a capacitance unit connected to a superposition point for the DC component and the AC component, a DC current measuring unit that measures the value of DC current passed from the charging member to the photoconductor when the voltage applying unit applies voltage to the charging member, a capacitance measuring unit that measures the electrostatic charge amount of current coming into the capacitance unit when the voltage applying unit applies the voltage to the charging member, and a control unit that integrates the DC current value measured by the DC current measuring unit with time for which the voltage is applied to the photoconductor and calculates a charge amount corresponding to the thickness of the photosensitive thin film by subtracting the electrostatic charge amount measured by the capacitance measuring unit from the result of integration.

BRIEF DESCRIPTION OF THE DRAWINGS

Exemplary embodiments of the invention will be described in detail in conjunction with the following figures, wherein.

DETAILED DESCRIPTION

First Exemplary Embodiment

Figure 1:
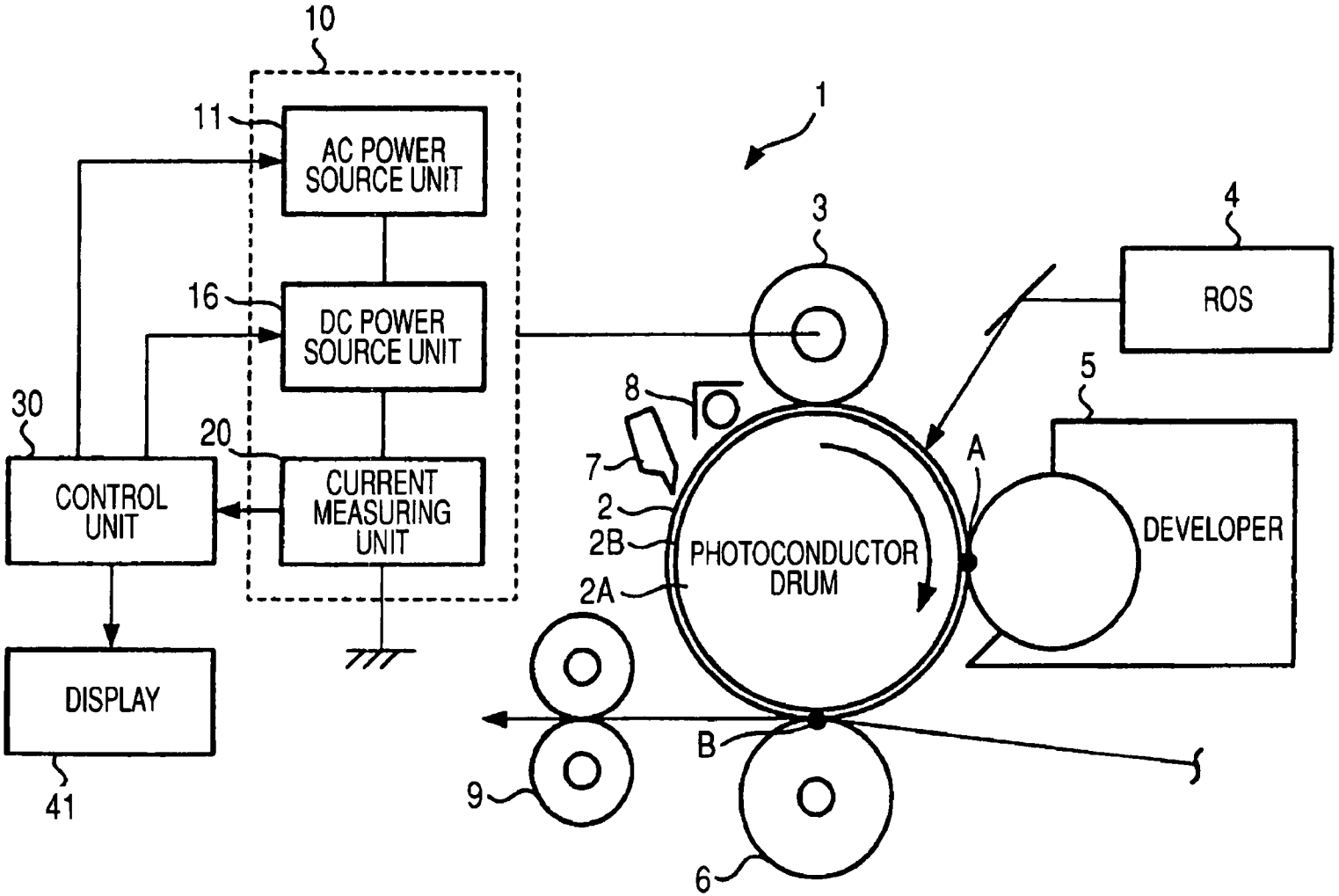
FIG. 1 is a schematic configurational diagram of the hardware of an image forming apparatus.

FIG. 1 is a schematic configurational diagram of the hardware of an image forming apparatus 1 according to an exemplary embodiment of the invention. A charging roller 3, an ROS 4, a developer 5, a transfer roller 6, a cleaning blade 7, a static eliminating lamp 8 and other elements are provided around a photoconductor drum 2 provided in the image forming apparatus 1.

The photoconductor drum 2 includes a conductive drum base 2A and a photosensitive thin film 2B of an OPC (Organic Photoconductor) formed the surface of the drum base 2A. The photoconductor drum 2 is driven to rotate at a predetermined process speed (peripheral velocity) in the clockwise direction as indicated by the arrow around the central axial line.

The charging roller (BCR: Bias Charging Roller) 3 is a charging member in contact with the photoconductor drum 2. The charging roller 3 rotates following the rotation of the photoconductor drum 2 and homogeneously charges a surface of the photoconductor drum 2 (negatively charged in the exemplary embodiment) to a predetermined potential in a predetermined polarity in response to high voltage supplied from a power supply device 10 that will be described.

The ROS (Raster Optical Scanner: image writing unit) 4 directs an image modulated laser beam to a surface of the photoconductor drum 2 to be charged (scanning exposure). The potential at the exposed part is attenuated and an electrostatic latent image forms at the photosensitive thin film 2B of the photoconductive drum 2. When the photoconductor drum 2 rotates and the electrostatic latent image comes to a developing position A opposing the developer 5, an amount of negatively charged toner is supplied from the developer 5 and a toner image is formed by reversal development.

The transfer roller 6 is positioned on the downstream side of the developer 5 when viewed in the rotation direction of the photoconductor drum 2 and provided in contact with the photoconductor drum 2 under pressure. The position of the nip portion between the transfer roller 6 and the photoconductor drum 2 is a transfer position B.

When the toner image formed on the surface of the photoconductor drum 2 reaches the transfer position B as the photoconductor drum 2 rotates, a paper sheet is supplied to the transfer position B in this timing, and predetermined voltage is applied to the transfer roller 6 at the same time, so that the toner image is transferred from the surface of the photoconductor drum 2 to the paper sheet. The paper sheet transferred with the toner image at the transfer position B is transported to a fixing unit, has its toner image fixed and is then discharged to the outside of the apparatus.

Meanwhile, the toner remaining on the surface of the photoconductor drum 2 after the transfer is scraped off with the cleaning blade 7, and the photoconductor drum 2 has its surface cleaned and readied for the next image forming operation. The electrostatic latent image on the photoconductor drum 2 is eliminated by the static eliminating lamp 8.

Now, a power supply system to the charging roller 3 will be described.

The power supply system includes a power supply device 10 including an AC power source unit 11 that supplies the charging roller 3 with high voltage, a DC power source unit 16, and a current measuring unit 20, and a control unit 30 that controls the operation of the power supply device 10.

Figure 2:
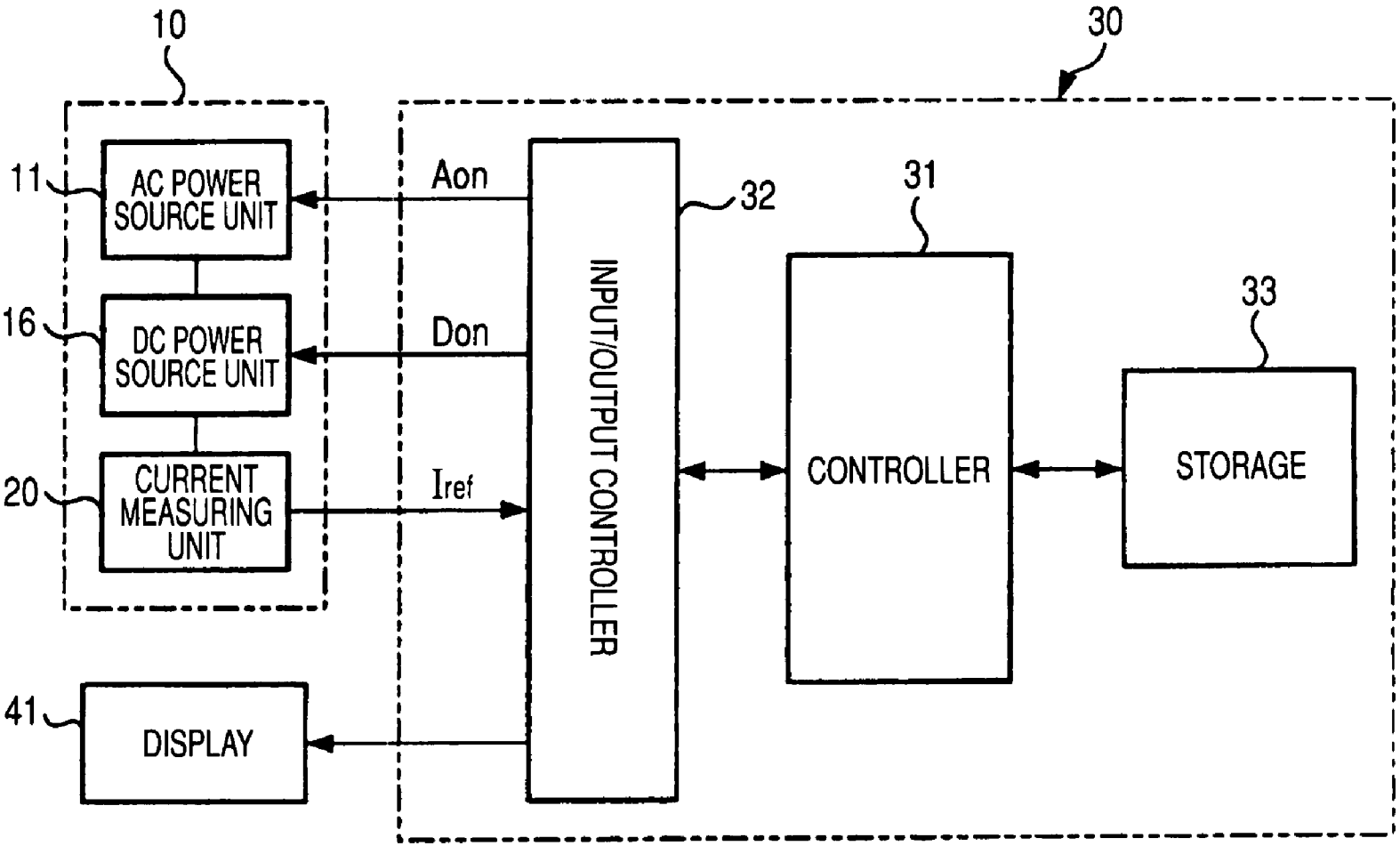
FIG. 2 is a block diagram of the configuration of the image forming apparatus.

The power supply device 10 includes the AC power source unit 11 that generates AC voltage as shown in the block diagram in FIG. 2 and the DC power source unit 16 that generates DC voltage. The configurations of the power source units 11 and 16 and the current measuring unit 20 will later be described. The current measuring unit 20 measures a measurement current Iref corresponding to a film thickness in a film thickness measuring mode.

The control unit 30 includes a controller 31, an input/output controller 32, and a memory 33 and these components each include a CPU (Central Processing Unit) or a RAM (Random Access Memory). The input/output controller 32 has its input and output sides connected with the AC power source unit 11 and the DC power source unit 16 of the power supply device 10 and its output side connected with a display 41. The control unit 30 outputs a command signal Aon to the AC power source unit 11 and a command signal Don to the DC power source unit 16.

The controller 31 carries out image forming processing, film thickness determination processing and the like that will be described according to a control program stored in the memory 33. Among these kinds of processing, the turning on/off and variation of a constant current output in the AC power source unit 11 and the turning on/off and variation of a constant voltage output in the DC power source unit 16 are carried out to keep the photosensitive thin film 2B of the photoconductor drum 2 homogeneously charged in the image forming processing. The film thickness determination processing is carried out separately from the image forming processing. The film thickness determination processing is carried out in a measuring mode in a preset condition (for example after printing a predetermined number of sheets, after elapse of a predetermined time period, or in response to a user command).

Figure 3:
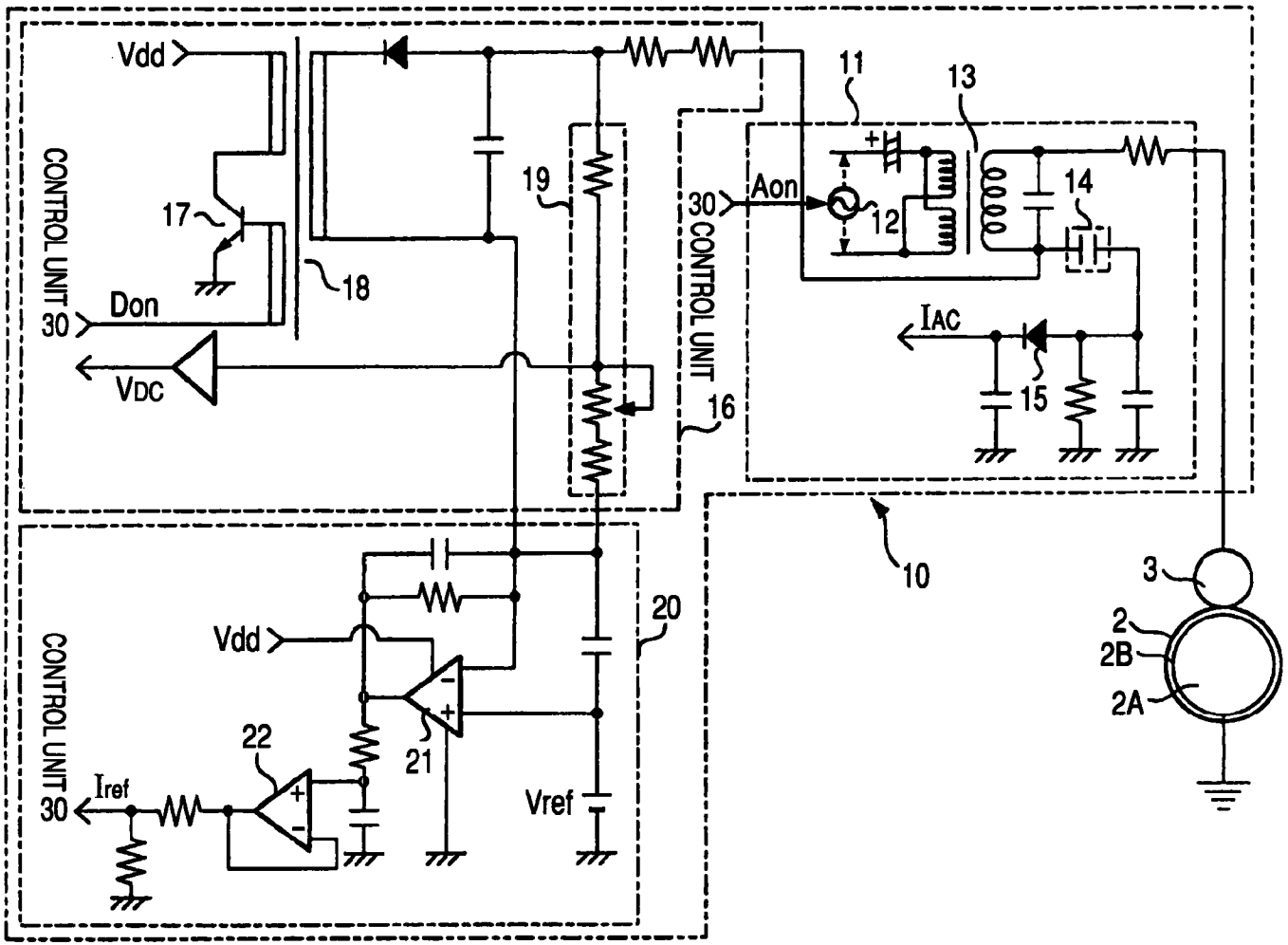
FIG. 3 is a diagram of the configuration of a power supply device.

Now, the configuration of the power supply device 10 will briefly be described with reference to the circuit diagram in FIG. 3.

In the AC power source unit 11, an AC power drive circuit 12 operates in response to a command signal Aon received from the control unit 30, a boosted AC component is produced through a transformer 13, and one end of the secondary side of the transformer 13 is connected to the charging roller 3. The other end of the secondary side of the transformer 13 is connected with an output from the DC power source unit 16 and a detection diode 15 through a DC regulating capacitor 14. The detection diode 15 feeds back the AC component of current passed through a circuit including the charging roller 3, the photoconductor drum 2, a ground, and a detection circuit as a half-wave rectified monitor signal IAC to a control section in the power supply device 10.

Note that the DC regulating capacitor 14 prevents the current of the AC component supplied from the AC current power source unit 11 from being passed to the ground side of the DC power source unit 16. Therefore, a capacitor with a capacitance C0 (such as 2200 pF) whose impedance is about ten times as large as that of the load capacitance is used. It is only necessary to increase the capacitance C0 of the DC regulating capacitor 14 in order to completely prevent the DC component current from being passed to the ground side, but if the capacitance is increased too much, the time constant when the AC component current is supplied becomes too large, which causes delayed response.

Therefore, in practice, the capacitance C0 is set in expectation of a small current flow to the ground side of the DC power source unit 16 through the DC regulating capacitor 14.

Upon receiving a command signal Don from the control unit 30, the DC power source unit 16 turns on a switching transistor 17 to apply DC specified voltage Vdd (for example 24 V) to the primary side of a transformer 18, and boosted DC voltage (for example −750 V) is produced through the transformer 18. One end of the secondary side of the transformer 18 is connected to the other end of the secondary side (low potential side) of the transformer 13 at the AC power source unit 11 and the DC component is superposed to the AC component. A voltage dividing resistor 19 and the current measuring unit 20 are connected in series to the output of the DC power source unit 16, a monitor signal VDC produced from a signal picked up from the midway of the voltage dividing resistor 19 is fed back to the control section in the power supply device 10.

The current measuring unit 20 is connected to the low potential side of the DC power source unit 16 and forms a differential circuit including OP amplifiers 21 and 22 activated in response to the specified voltage Vdd as basic components. The ground of the current measuring unit 20 is used in common as the ground of the photoconductor drum 2, and therefore current passed through the photosensitive thin film 2B of the photoconductor drum 2 through the charging roller 3 comes into the current measuring unit 20. Then, current corresponding to the circuit constant (impedance) of the current measuring unit 20 is measured as a measurement current Iref. The measurement current Iref measured at the current measuring unit 20 is output to the control unit 30.

The AC component of the voltage supplied to the charging roller 3 and the photoconductor drum 2 forms a closed circuit with the AC power source unit 11 through the ground of the photoconductor drum 2, and the DC component forms a closed circuit with the DC power source unit 16 and the AC power source unit 11 through the ground of the photoconductor drum 2 and the current measuring unit 20.

Now, with reference to the flowchart in FIG. 4, the film thickness determination processing according to the exemplary embodiment will be described.

The control unit 30 determines whether or not a film thickness measuring mode is attained (step S10). If the film thickness measuring mode is attained (YES in step S10), it is then determined whether or not an electrostatic charge amount measuring mode is attained (step S20). In the electrostatic charge amount measuring mode, the amount of charge possessed by the DC regulating capacitor 14 is measured.

If the electrostatic charge amount measuring mode is attained (YES in step S20), the control unit 30 outputs a command signal Don to the DC power source unit 16 that makes a command for applying voltage in a level insufficient to charge the photosensitive thin film 2B (for example −400 V) (step S30). Upon receiving the command signal Don, the DC power source unit 16 supplies DC component current to the charging roller 3. In this way, the DC component current is supplied to the charging roller 3, but the charge is not supplied from the charging roller 3 to the photosensitive thin film 2B, and the charge comes into the current measuring unit 20.

The control unit 30 reads the measurement current Iref for the current coming into the current measuring unit 20 (step S40). The control unit 30 then calculates an electrostatic charge amount Q2 by integrating the read measurement current Iref with the time for which the DC component current is supplied (step S50) and stores the electrostatic charge amount Q2 in the memory 33 (step S60).

Then, the control unit 30 outputs a command signal Aon to the AC power source unit 11 (step S70) and then outputs a command signal Don to the DC power source unit 16 that makes a command for applying voltage about in a level sufficient to charge the photosensitive thin film 2B (for example −750 V) (step S80). In this way, current produced by superposing the DC component to the AC component is sequentially supplied to the charging roller 3 and charges the photosensitive thin film 2B, and then the current comes into the current measuring unit 20. The current produced by superposing the DC component to the AC component is used because a material having a dielectric constant close to that of an insulator is charged.

The control unit 30 reads the measurement current Iref for the current coming into the current measuring unit 20 (step S90). The control unit 30 then integrates the read measurement current Iref with the time for which the current of superposed components is supplied to produce an integrated charge amount Q1 (step S100).

The control unit 30 reads out the electrostatic charge amount Q2 stored in the memory 33 in step S60 (step S110), and the electrostatic charge amount Q2 is subtracted from the integrated charge amount Q1 obtained in step S100 to produce a charge amount Q3 (step S120).

The control unit 30 determines whether or not the charge amount Q3 exceeds the threshold charge amount Q0 (step S130) If Q3>Q0 holds (YES in step S130) in the determination processing, the photosensitive thin film 2B reaches a limit value for film reduction (limit film thickness), and therefore a command for requesting "replacement of the photoconductor drum" is indicated at the display 41 (step S140).

The control unit 30 then stops outputting the command signal Don to the DC power source unit 16 (step S150) and stops outputting the command signal Aon to the AC power source unit 11 (step S160), and the film thickness determination processing ends.

The film thickness determination processing will be described further in detail with reference to FIGS. 5A, 5B, 6A and 6B.

Figure 5A:
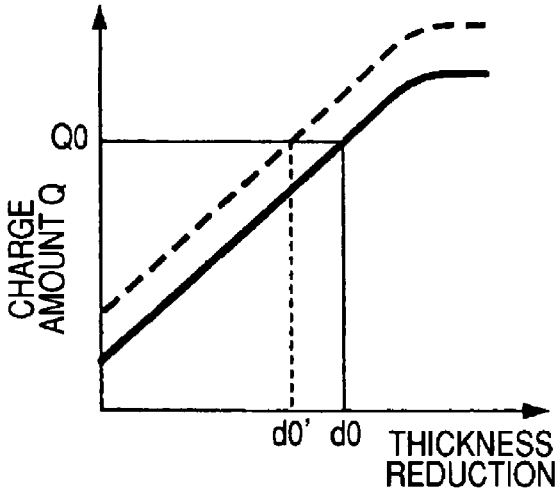
FIGS. 5A and 5B are characteristic graphs representing the relation of a charge amount and a resistance value to thickness reduction in a photosensitive thin film.
Figure 5B:
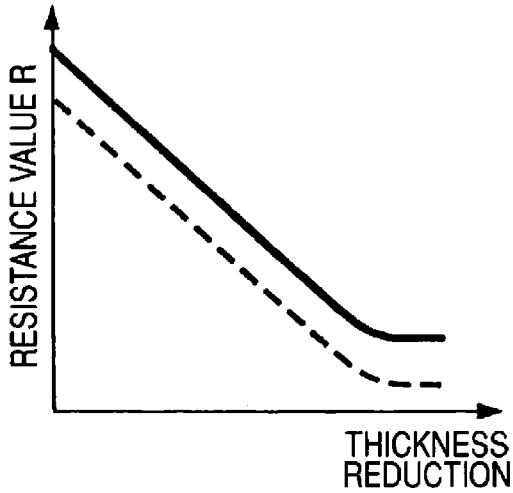
Figure 6A:
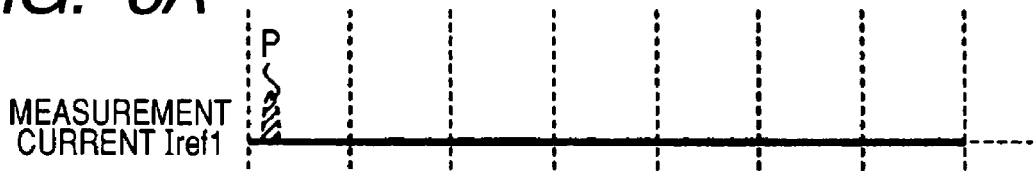
FIGS. 6A and 6B are charts showing measurement current in a film thickness measuring mode with respect to the time base.
Figure 6B:
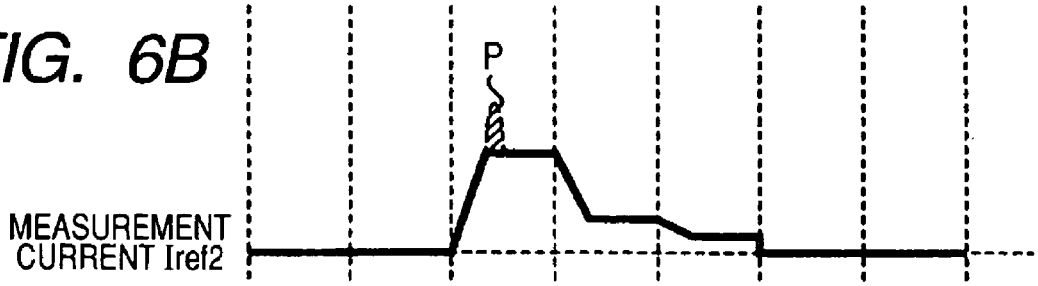

FIG. 5A shows the characteristic of the charge amount Q of the photosensitive thin film 2B according to reduction in the thickness of the photosensitive thin film 2B. FIG. 5B shows the characteristic of the resistance value R of the photosensitive thin film 2B according to reduction in the thickness of the photosensitive thin film 2B. FIGS. 6A and 6B show the measurement current Iref in the film thickness measuring mode with respect to the time base, and each interval on the scale of the abscissa represents time for the photoconductor drum 2 to make one rotation. Note that electricity is described in terms of current for the ease of description.

As can be seen from FIG. 5A, at the photoconductor drum 2, the charge amount Q increases as a function of increase in the reduction in the thickness of the photosensitive thin film 2B (i.e., as the film thickness decreases), and the charge limit is reached when the wear limit for the photosensitive thin film 2B is reached. The characteristic of the resistance value R shown in FIG. 5B is inversely proportional to the charge amount Q and therefore the resistance value R decreases as the film thickness decreases.

As described above, the DC regulating capacitor 14 prevents the DC component current from coming into the ground side. When however the DC component current is supplied, a potential difference is generated at the DC regulating capacitor 14 and current is transiently passed, which causes overshoot in the measurement current Iref. The overshoot causes the actually measured values to follow the characteristic lines as denoted by the dotted lines in FIGS. 6A and 6B.

In contrast, in the film thickness determination processing in step S30, the command signal Don that makes a command for applying voltage in a level insufficient to charge the photosensitive thin film 2B (for example −400 V) is output to the DC power source unit 16, and DC component current is supplied from the DC power source unit 16 to the charging roller 3 for the time for which the photoconductor drum 2 makes two rotations. When the measurement current Iref for the current coming into the current measuring unit 20 is read (step S40), and the measurement current Iref is integrated with the time corresponding to three rotations of the drum for which the DC component current is supplied (step S50), an electrostatic charge amount Q2 substantially equal to the overshoot by the DC regulating capacitor 14 can be obtained as indicated by the measurement current Iref1 in FIG. 6.

Then in step S70, a command signal Aon is output to the AC power source unit 11 and AC component current is supplied from the AC power source unit 11 to the charging roller 3 for the time in which the photoconductor drum 2 makes two rotations. In this state, a command signal Don that makes a command for applying voltage in a level sufficient to charge the photosensitive thin film 2B (for example −750 V) is output to the DC power source unit 16 in step S80, and DC component current is supplied from the DC power source unit 16 to the charging roller 3 for the period in which the photoconductor drum makes three rotations. The measurement current Iref for the current coming into the current measurement portion 20 is read (step S90) and the measurement current Iref is integrated with the time corresponding to three rotations of the drum for which the DC component current is supplied (S100). Then, as indicated by the measurement current Iref2 in FIG. 6, an electrostatic charge amount Q1 substantially equal to the sum of the charge amount of the photosensitive thin film 2B and the overshoot by the DC regulating capacitor 14 can be obtained.

Therefore, the charge amount obtained by subtracting the electrostatic charge amount Q1 from the electrostatic charge amount Q2 can be interpreted as the charge amount of the photosensitive thin film 2B itself.

According to the exemplary embodiment described above, the overshoot in the measurement current Iref generated when the DC component current is supplied to the photoconductor drum 2 through the charging roller 3 is measured, and then an electrostatic charge amount obtained based on the measurement result is removed by the processing in the control unit 30. In this way, the electrostatic charge amount Q3 removed of the overshoot is calculated. The calculated electrostatic charge amount Q3 is represented by the solid line in FIG. 5A, and therefore an accurate value is indicated as the amount of thickness reduction corresponding to the charge amount of the photosensitive thin film 2B itself.

Consequently, erroneous determination as would be encountered in the case of using the charge amount Q including the overshoot such as erroneously determining replacement timing for the photoconductor drum 2 though the drum has not yet reached the limit of its usefulness can be prevented, and the reliability of the image forming apparatus 1 can be improved.

Furthermore, the charge amount is calculated based on the actual measurement value in the electrostatic charge amount measuring mode, and therefore if the capacitance C0 of the DC regulating capacitor 14 changes for each film thickness determination processing, the charge amount Q3 with a reduced error can be calculated by accurately calculating the electrostatic charge amount Q2.

Second Exemplary Embodiment

A second exemplary embodiment of the invention will be described.

Figure 7:
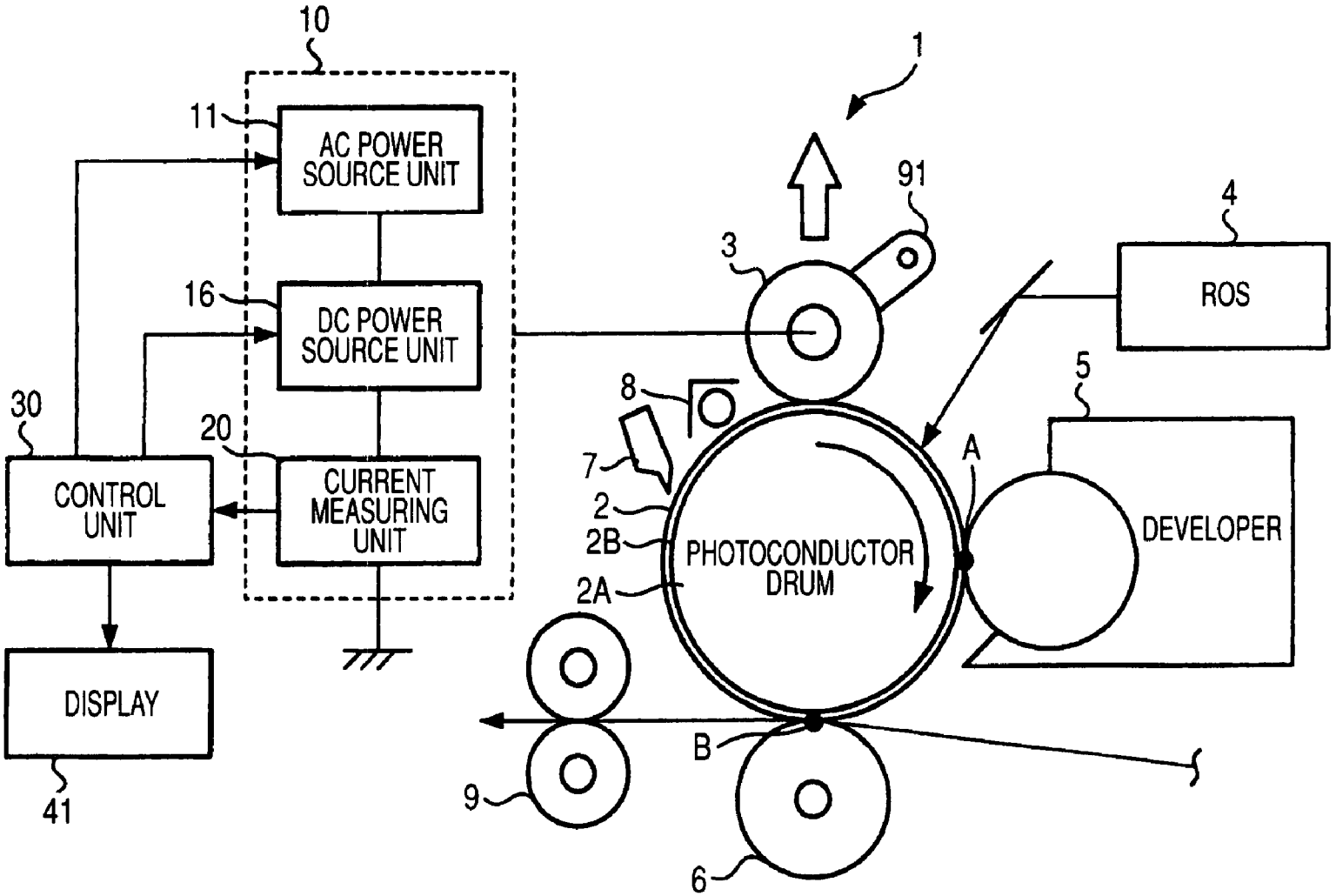
FIG. 7 is a schematic configurational diagram of the hardware of an image forming apparatus (according to a second exemplary embodiment)

FIG. 7 is a schematic configurational diagram of the hardware of an image forming apparatus 1 according to the exemplary embodiment. As shown in FIG. 7, the image forming apparatus 1 is different from the first exemplary embodiment in that the device includes a retract driving part 91 that separates the charging roller 3 from the photoconductor drum 2 at such a distance that the photosensitive thin film 2B of the photoconductor drum 2 is not charged.

Figure 8:
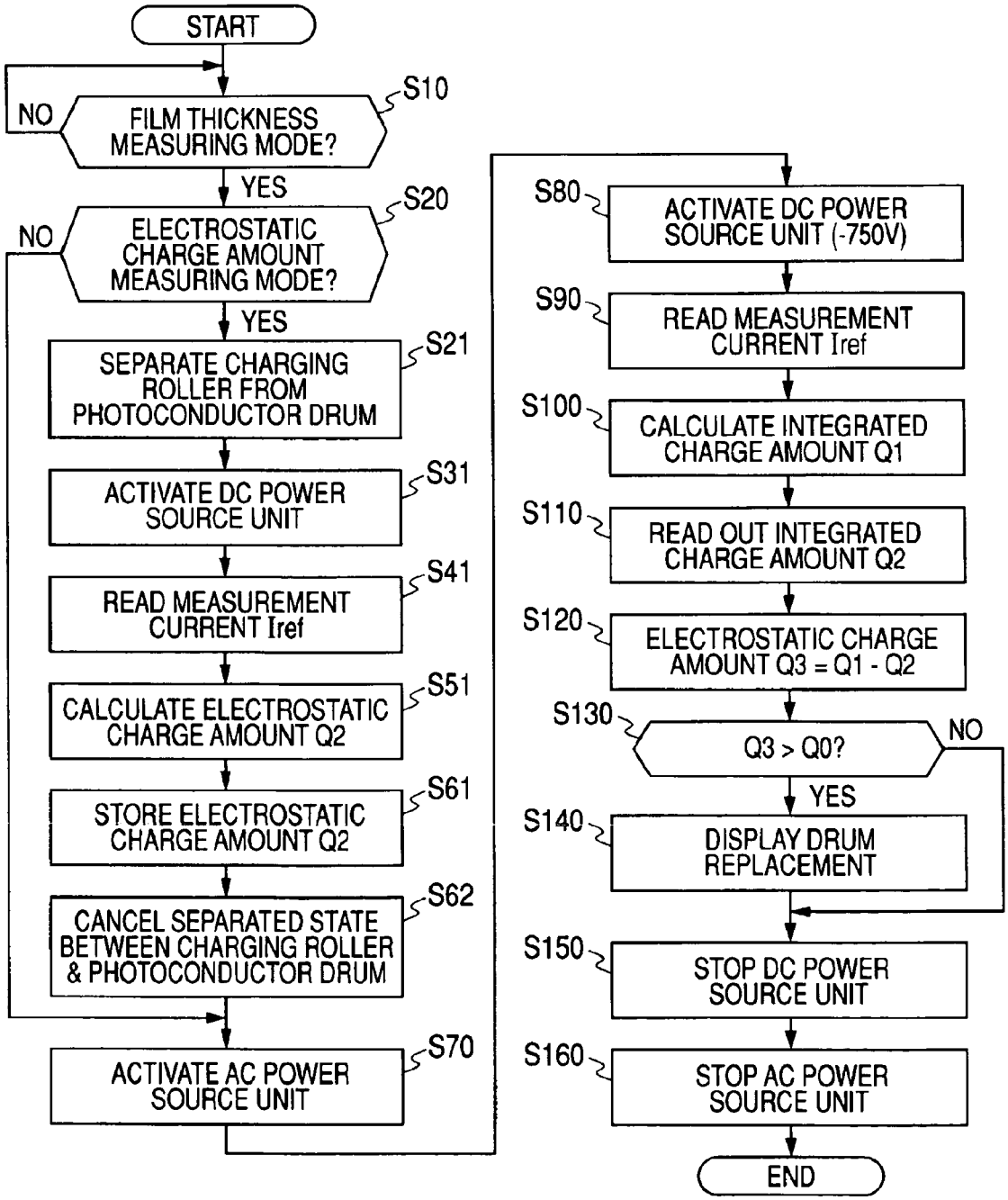
FIG. 8 is a flowchart for use in illustrating film thickness determination processing (according to the second exemplary embodiment)

FIG. 8 is a flowchart for use in illustrating film thickness determination processing according to the exemplary embodiment. In FIG. 8, the processing in the electrostatic charge amount measuring mode from steps S30 to S60 shown in FIG. 4 is replaced by processing from steps S21 to S62. The processing in the series of steps will be described. When the electrostatic charge amount measuring mode is attained (YES in step S20), the control unit 30 separates the charging roller 3 from the photoconductor drum 2 (step S21). The control unit 30 then outputs a command signal Don that makes a command for applying voltage to the DC power source unit 16 (step S31). Upon receiving the command signal Don, the DC power source unit 16 supplies DC component current to the charging roller 3 through the other end of the secondary side of the transformer 13 in the AC power source unit 11. However, since the charging roller 3 is separated from the photoconductor drum 2 by the retract driving part 91, only current leaked to the DC regulating capacitor 14 is allowed to come into the current measuring unit 20.

The control unit 30 reads the measurement current Iref for the current coming into the current measuring unit 20 (step S41). The control unit 30 calculates an electrostatic charge amount Q2 by integrating the read measurement current Iref with the time for which the DC component current is supplied (step S51), stores the electrostatic charge mount Q2 in the memory 33 (step S61), and then cancels the separated state of the charging roller 3 and the photoconductor drum 2 (step S62).

Figure 4:
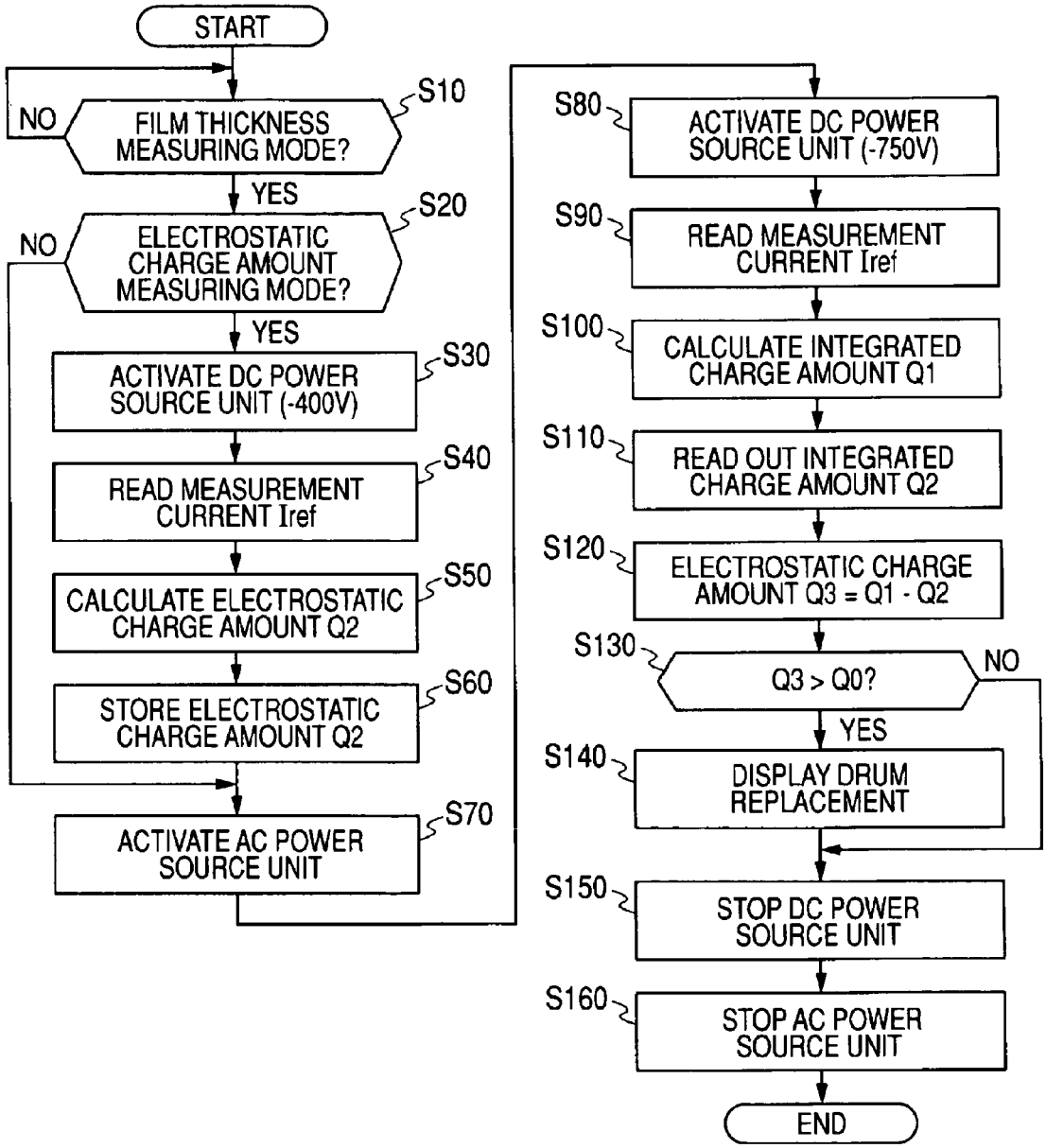
FIG. 4 is a flowchart for use in illustrating film thickness determination processing.

Thereafter, the same processing as that in and after step S70 in FIG. 4 is carried out.

Third Exemplary Embodiment

A third exemplary embodiment of the invention will be described.

Figure 9:
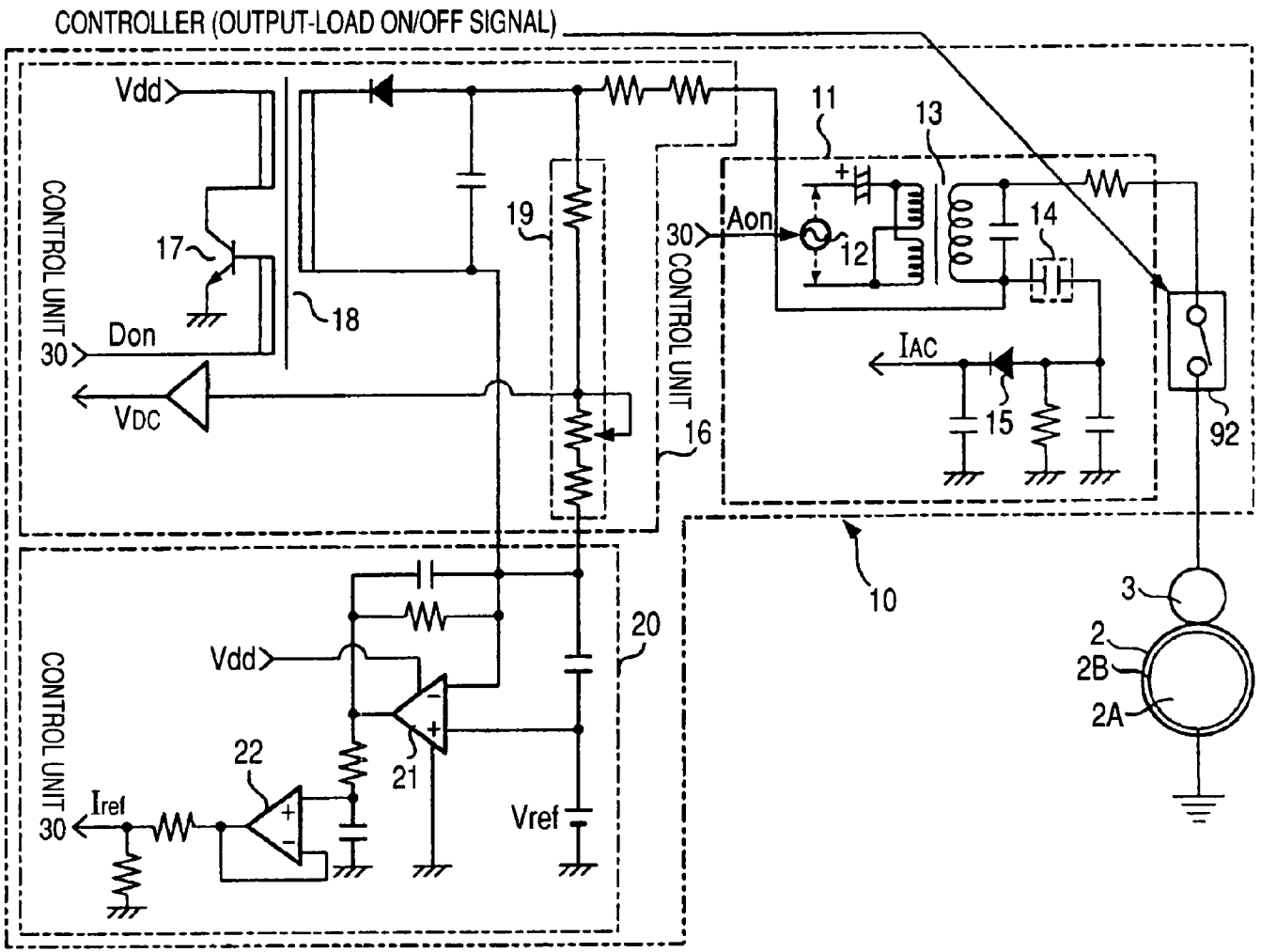
FIG. 9 is a diagram of a power supply system for a charging roller (according to a third exemplary embodiment)

FIG. 9 is a circuit diagram of a power supply device 10 in an image forming apparatus 1 according to the exemplary embodiment. As shown in FIG. 9, the power supply device 10 includes a switch 92 on a wire from the other end of the secondary side of the transformer 13 in the AC power source unit 11 serving as a superposing position for the AC and DC components to the charging roller 3. The switch 92 opens/closes in response to an output-load ON/OFF signal from the control unit 30.

Figure 10:
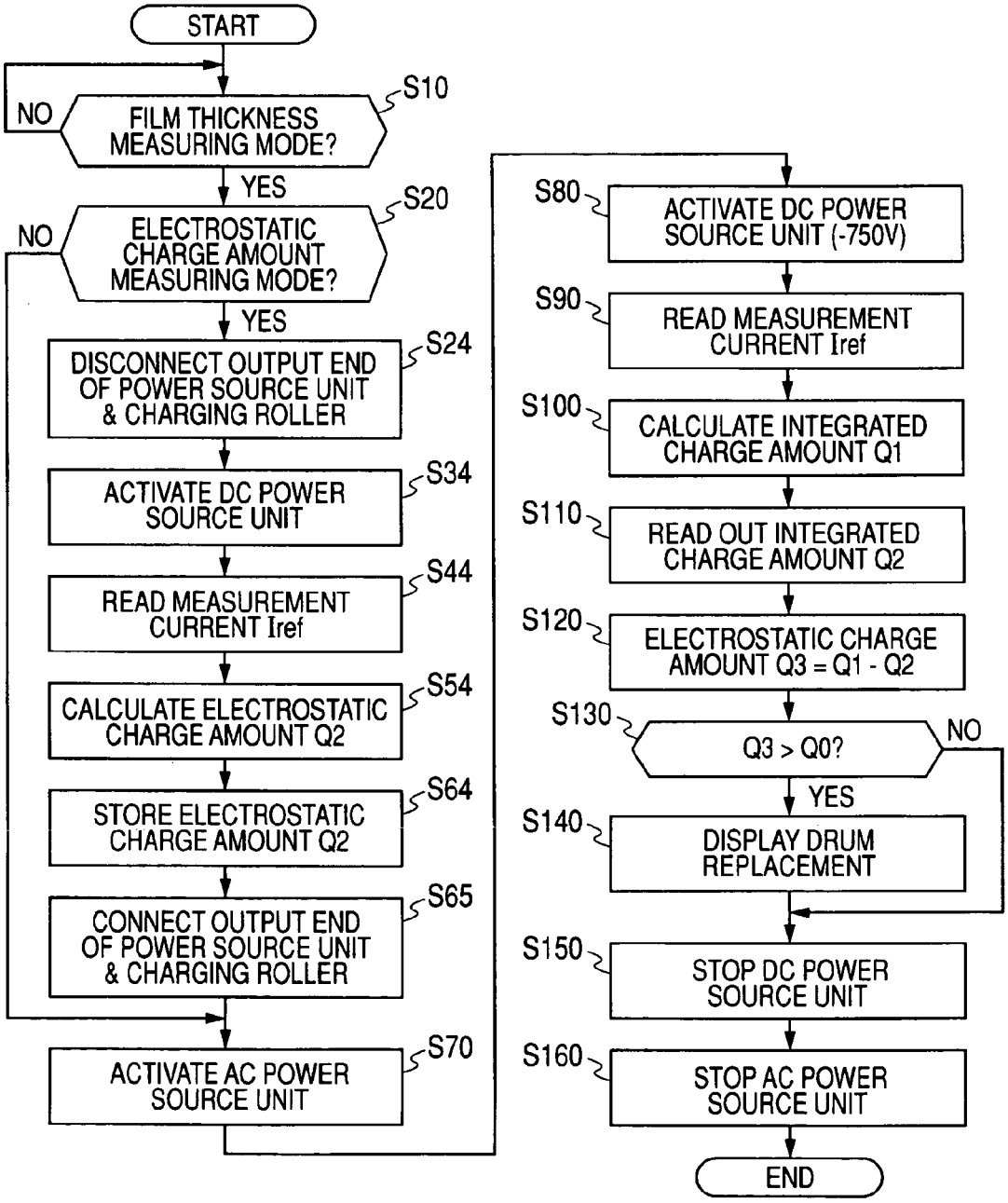
FIG. 10 is a flowchart for use in illustrating film thickness determination processing (according to the third exemplary embodiment)

FIG. 10 is a flowchart for use in illustrating film thickness determination processing according to the exemplary embodiment. In FIG. 10, the processing in the electrostatic charge amount measuring mode from steps S30 to S60 in FIG. 4 is replaced by the processing from steps S24 to S65. The processing in the series of steps will be described. When the electrostatic charge amount measuring mode is attained (YES in step S20), the control unit 30 supplies an output-load ON/OFF signal and thus opens the output end of the power supply, in other words, opens the switch 92 between the other end of the secondary side of the transformer 13 in the AC power source unit 11 and the charging roller 3 (step S24). The control unit then outputs a command signal Don that makes a command for applying voltage to the DC power source unit 16 (Step S34). Upon receiving the command signal Don, the DC power source unit 16 supplies DC component current to the other end of the secondary side of the transformer 13 in the AC power source unit 11. However, the switch on the wire from the other end of the secondary side of the transformer 13 in the AC power source unit 11 to the charging roller 3 is opened, and therefore only the current leaked to the DC regulating capacitor 14 is allowed to come into the current measuring unit 20.

The control unit 30 reads the measurement current Iref for the current coming into the current measuring unit 20 (step S44). The control unit 30 calculates the electrostatic charge amount Q2 by integrating the read measurement current Iref with the time for which the DC component current is supplied (step S54), and the electrostatic charge amount Q2 is stored in the storage 33 (step S64).

The control unit 30 connects the switch between the other end of the secondary side of the transformer 13 in the AC power source unit 11 and the charging roller 3 (step S65), and thereafter the same processing as that in and after step S70 shown in FIG. 4 is carried out.

Fourth Exemplary Embodiment

A fourth exemplary embodiment of the invention will be described.

Figure 11:
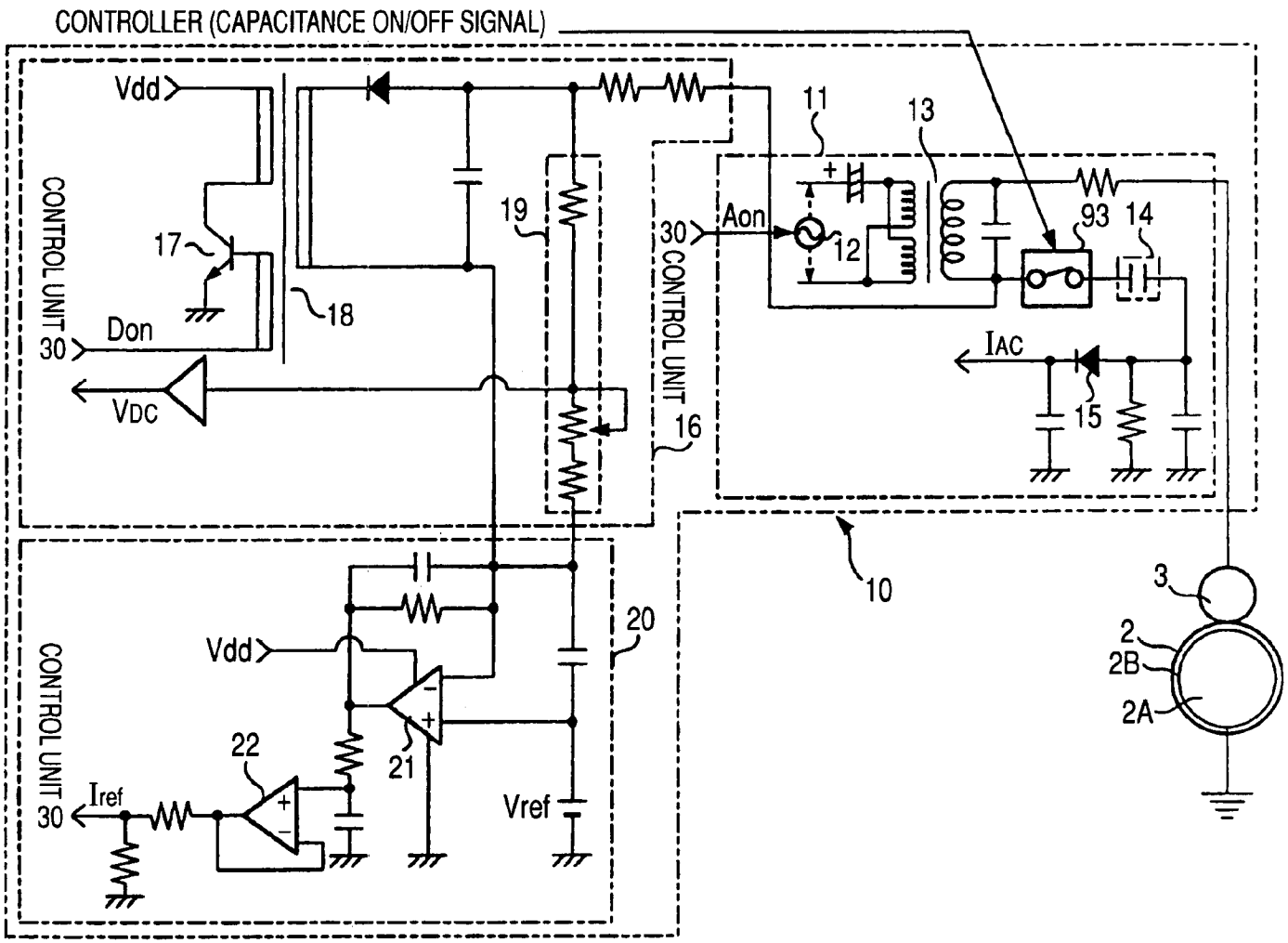
FIG. 11 is a diagram of a power supply system for a charging roller (according to a fourth exemplary embodiment)

FIG. 11 is a circuit diagram of a power supply device 10 in an image forming apparatus 1 according to the exemplary embodiment. As shown in FIG. 11, the power supply device 10 includes a switch 93 between the other end of the secondary side of a transformer 13 of an AC power source unit 11 as a superposition point between AC and DC components and a DC regulating capacitor 14. The switch 93 opens/closes in response to a capacitance ON/OFF signal from the control unit 30.

Figure 12:
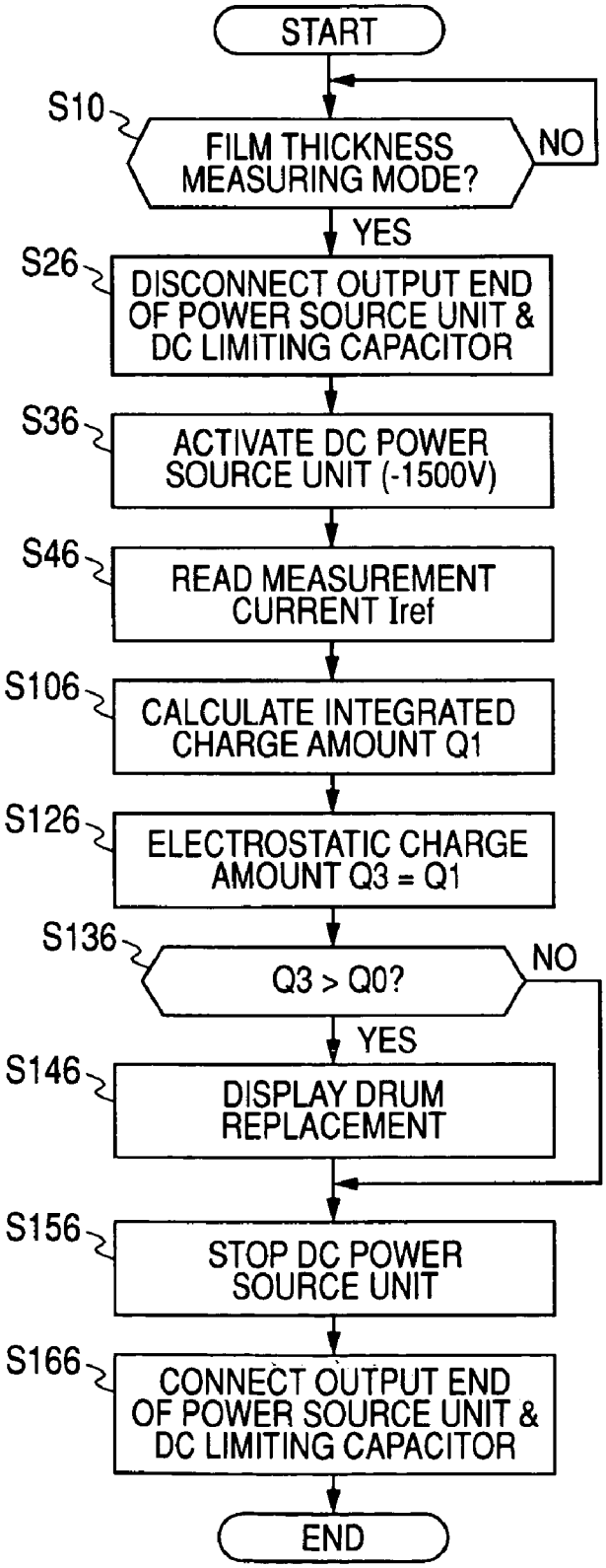
FIG. 12 is a flowchart for use in illustrating film thickness determination processing (according to the fourth exemplary embodiment)
Figure 13:
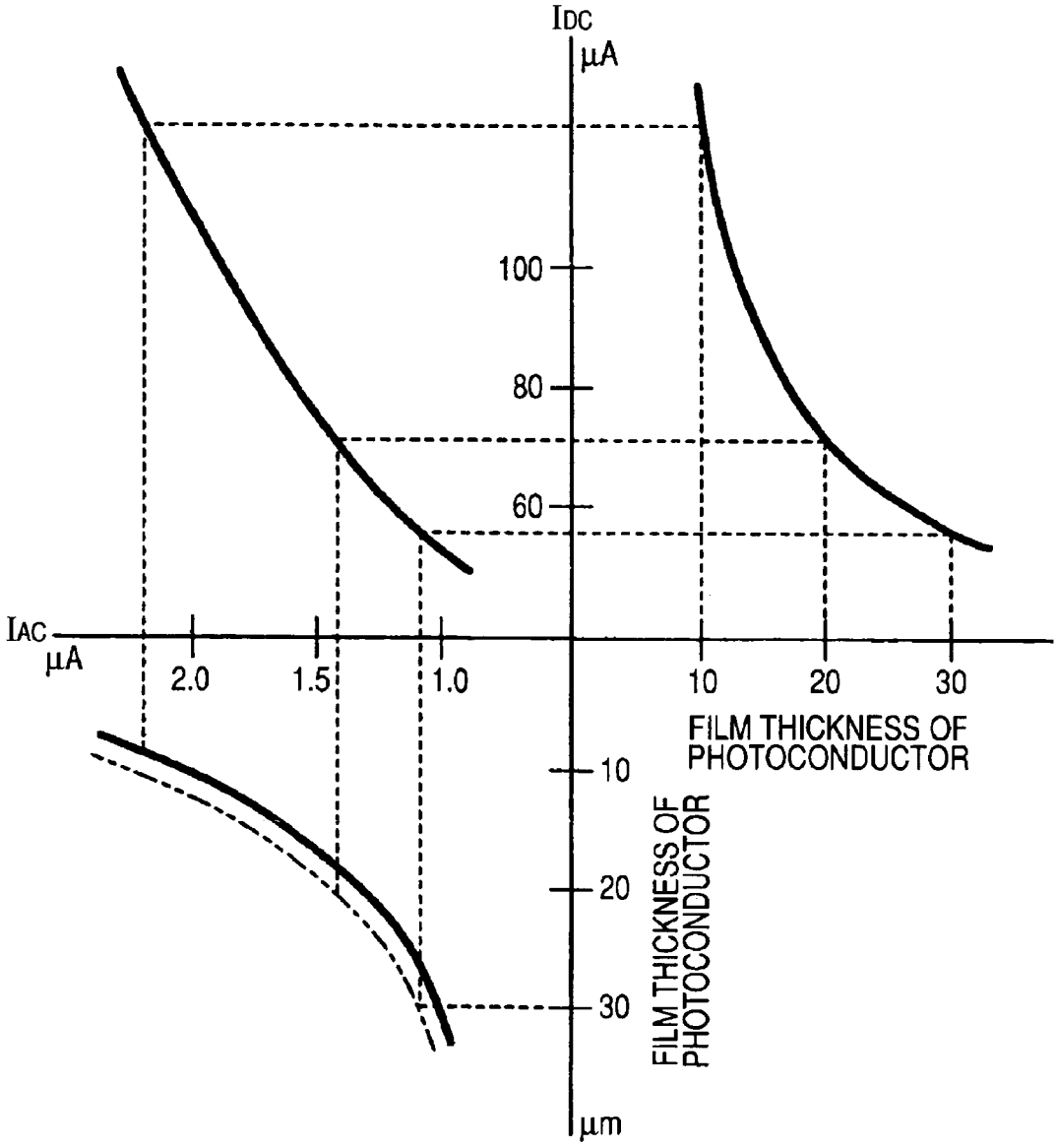
FIG. 13 RELATED ART
FIG. 13 is a diagram for use in illustrating related art.

FIG. 12 is a flowchart for use in illustrating film thickness determination processing according to the exemplary embodiment.

The control unit 30 determines whether or not a film thickness measuring mode is attained (step S10). If a film thickness measuring mode is attained (YES in step S10), a capacitance ON/OFF signal is supplied. In this way, the switch 93 between the output end of the power supply, in other words, the other end of the secondary side of the transformer 13 in the AC power source unit 11 and the DC regulating capacitor 14 is opened (step S26), and then the control unit outputs a command signal Don that makes a command for applying voltage in a level sufficient to charge the photosensitive thin film 2B (for example −1500 V) to the DC power source unit 16 (step S36). Upon receiving the command signal Don, the DC power source unit 16 supplies DC component current to the other end of the secondary side of the transformer 13 in the AC power source unit 11. Then, DC component current sufficient to charge the photosensitive thin film 2B is sequentially supplied to the charging roller 3, charges the photosensitive thin film 2B, and then is allowed to come into the current measuring unit 20.

The control unit 30 reads the measurement current Iref for the current coming into the current measuring unit 20 (step S46). The control unit 30 then calculates an integrated charge amount Q1 by integrating the read measurement current Iref with the time for which the current for superposed components is supplied (step S106), and the integrated charge amount Q1 is determined as a charge amount Q3 (step S126).

The control unit 30 then determines whether or not the charge amount Q3 obtained in step S126 exceeds the threshold charge amount Q0 (step S136). If Q3>Q1 holds (YES in step S136) in the determination processing, the reduction in the photosensitive thin film 2B has reached the limit value (limit film thickness), and therefore a command for requesting "replacement of photoconductor drum 2" is indicated at the display 41 (step S146).

The control unit 30 also stops outputting the command signal Don to the DC power source unit 16 (step S156), supplies a capacitance ON/OFF signal to connect the switch 93 between the other end of the secondary side of the transformer 13 in the AC power source unit 11 and the DC regulating capacitor 14 (step S166) and then ends the film thickness determination processing.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

a photoconductor driven to rotate and having a photosensitive thin film formed on its surface;

a charging member that charges the photosensitive thin film of the photoconductor;

a voltage applying unit that applies voltage of a DC component and voltage of an AC component to the charging member;

a control unit that determines a film thickness measuring mode is enabled: a capacitance unit connected to a superposition point for the DC component and the AC component;

a DC current measuring unit that measures the value of DC current passed from the charging member to the photoconductor when the voltage applying unit applies both voltage of a DC component and voltage of an AC component to the charging member during the film thickness measuring mode;

a retract driving unit that separates the charging member from the photoconductor; and a capacitance measuring unit that measures the electrostatic charge amount of current coming into the capacitance unit when the voltage applying unit applies the voltage of a DC component to the charging member during the film thickness measuring mode, wherein the control unit integrates the DC current value measured by the DC current measuring unit with time for which the voltage is applied to the photoconductor and calculates a charge amount to determine a thickness of the photosensitive thin film from the electrostatic charge amount measured by the capacitance measuring unit and a result of the integration.

2. The image forming apparatus according to claim 1, wherein the control unit controls the voltage applying unit to apply voltage of a DC component in a level insufficient to charge the photosensitive thin film, the capacitance measuring unit measures the electrostatic charge amount of current coming into the capacitance unit in response to the voltage application, and the control unit subtracts the result of measurement from the result of integration.

3. The image forming apparatus according to claim 1, wherein the control unit controls the voltage applying unit to apply voltage while the charging member is separated from the photosensitive thin film at a distance insufficient to allow the photosensitive thin film to be charged, the capacitance measuring unit measures the electrostatic charge amount of current coming into the capacitance unit in response to the voltage application, and the control unit subtracts the result of measurement from the result of integration.

4. The image forming apparatus according to claim 1, wherein the control unit controls the voltage applying unit to apply voltage while a wire from the voltage applying unit to the charging member is opened, the capacitance measuring unit measures the electrostatic charge amount of current coming into the capacitance unit in response to the voltage application, and the control unit subtracts the result of measurement from the result of integration.

5. The image forming apparatus according to claim 1, further comprising a notification unit that notifies that the limit of a useful life is reached when the calculated charge amount exceeds a predetermined charge amount corresponding to a predetermined film thickness.

6. The image forming apparatus according to claim 1, wherein the photoconductor is a photoconductor drum, and the charging member is a charging roller provided in contact or in a close proximity with a surface of the photoconductor drum and moved following the rotation of the photoconductor drum.

7. An image forming apparatus, comprising:

a photoconductor driven to rotate and having a photosensitive thin film formed on its surface;

a charging member that charges the photosensitive thin film of the photoconductor;

a retract driving unit that separates the charging member from the photoconductor; and a voltage applying unit that applies voltage of a DC component and voltage of an AC component to the charging member;

a control unit that determines a film thickness measuring mode is enabled;

a capacitance unit connected to a superposition point for the DC component and the AC component;

a DC current measuring unit that measures the value of DC current passed from the charging member to the photoconductor when the voltage applying unit applies both voltage of a DC component and voltage of an AC component to the charging member during the film thickness measuring mode; and a capacitance measuring unit that measures the electrostatic charge amount of current coming into the capacitance unit when the voltage applying unit applies the voltage of a DC component to the charging member during the film thickness measuring mode, wherein the control unit controls the voltage applying unit to apply DC component voltage in a level sufficient to charge the photosensitive thin film while a circuit from the voltage applying unit to the capacitance unit is opened and calculates a charge amount to determine a thickness of the photosensitive thin film from the electrostatic charge amount measured by the capacitance measuring unit and a result of an integration.

8. The image forming apparatus according to claim 7, further comprising notification unit that notifies that the limit of a useful life is reached when the calculated charge amount exceeds a predetermined charge amount corresponding to a predetermined film thickness.

9. The image forming apparatus according to claim 7, wherein the photoconductor is a photoconductor drum, and the charging member is a charging roller provided in contact or in a close proximity with a surface of the photoconductor drum and moved following the rotation of the photoconductor drum.

10. An image forming method using an image forming apparatus including; a photoconductor driven to rotate and having a photosensitive thin film formed on its surface; a charging member that charges the photosensitive thin film of the photoconductor; a voltage applying unit that applies voltage of a DC component and voltage of an AC component to the charging member; a capacitance unit connected to a superposition point for the DC component and the AC component; the image forming method comprising:

determining a film thickness measuring mode is enabled;

measuring the value of DC current passed from the charging member to the photoconductor when the voltage applying unit applies both voltage of a DC component and voltage of an AC component to the charging member during the film thickness measuring mode;

separating the charging member from the photoconductor;

measuring the electrostatic charge amount of current coming into the capacitance unit when the voltage applying unit applies the voltage of a DC component voltage to the charging member;

integrating the measured DC current value with time for which the voltage is applied to the photoconductor; and calculating a charge amount to determine a thickness of the photosensitive thin film from the electrostatic charge amount measured and the integrated measured DC current value.

11. An image forming apparatus, comprising:

a photoconductor driven to rotate and having a photosensitive thin film formed on its surface;

a charging member that charges the photosensitive thin film of the photoconductor;

a voltage applying unit that applies voltage of a DC component and voltage of an AC component to the charging member;

a control unit that determines a film thickness measuring mode is enabled;

a capacitance unit connected to a superposition point for the DC component and the AC component;

a DC current measuring unit that measures the value of DC current passed from the charging member to the photoconductor when the voltage applying unit applies both voltage of a DC component and voltage of an AC component to the charging member during the film thickness measuring mode; and a capacitance measuring unit that measures the electrostatic charge amount of current coming into the capacitance unit when the voltage applying unit applies the voltage of a DC component to the charging member during the film thickness measuring mode, wherein the control unit integrates the DC current value measured by the DC current measuring unit with time for which the voltage is applied to the photoconductor and calculates a charge amount to determine a thickness of the photosensitive thin film from the electrostatic charge amount measured by the capacitance measuring unit and a result of the integration.

12. An image forming apparatus, comprising:

a photoconductor driven to rotate and having a photosensitive thin film formed on its surface;

a charging member that charges the photosensitive thin film of the photoconductor; and a voltage applying unit that applies voltage of a DC component and voltage of an AC component to the charging member;

a control unit that determines a film thickness measuring mode is enabled;

a capacitance unit connected to a superposition point for the DC component and the AC component;

a DC current measuring unit that measures the value of DC current passed from the charging member to the photoconductor when the voltage applying unit applies both voltage of a DC component and voltage of an AC component to the charging member during the film thickness measuring mode; and a capacitance measuring unit that measures the electrostatic charge amount of current coming into the capacitance unit when the voltage applying unit applies the voltage of a DC component to the charging member during the film thickness measuring mode, wherein the control unit that controls the voltage applying unit to apply DC component voltage in a level sufficient to charge the photosensitive thin film while a circuit from the voltage applying unit to the capacitance unit is opened and calculates a charge amount to determine a thickness of the photosensitive thin film from the electrostatic charge amount measured by the capacitance measuring unit and a result of an integration.

* * * * *